United States Patent [19]

Dodonov

[11] 4,284,924

[45] Aug. 18, 1981

[54] MICROWAVE MAGNETRON-TYPE DEVICE

[76] Inventor: Jury I. Dodonov, Profsojuznaya ulitsa, 93, korpus 2, kv. 384, Moscow, U.S.S.R.

[21] Appl. No.: 75,205

[22] Filed: Sep. 12, 1979

[51] Int. Cl.[3] ..... H01J 25/50

[52] U.S. Cl. ..... 315/39.51; 315/39.71

[58] Field of Search ..... 315/39.51, 39.71, 39.75

[56] References Cited

U.S. PATENT DOCUMENTS

| | | | |
|---|---|---|---|
| 2,496,500 | 2/1950 | Spencer | 315/39.69 |
| 3,027,488 | 3/1962 | Winsor | 315/39.69 |
| 3,045,147 | 7/1962 | Butler | 315/39.69 |
| 4,028,583 | 6/1977 | Bigham | 315/39.69 |
| 4,063,129 | 12/1977 | Miura et al. | 315/39.71 |

*Primary Examiner*—Saxfield Chatmon, Jr.
*Attorney, Agent, or Firm*—Fleit & Jacobson

[57] ABSTRACT

A microwave magnetron-type device comprises at least one anode block with annular metal straps electrically associated with respective vanes of the anode block cavities, having the same polarity at -mode. The straps of different polarities, electrically associating respective vanes of the same polarity, are paired, each pair being arranged with respect to one another along the anode block axis to form a single multistage retardation system. The device also comprises a means for creating a magnetic field directed along the anode block axis enveloping said anode block, and a means for increasing the magnetic field density in direct proximity to the anode block end faces, forming a gap with the end faces of the anode block. At least some of said straps are made at least partically of a magnetic material, and the mass of this material is so distributed along the anode block axis that the magnetic field density varies along the anode block axis as follows:

$$B_x = B_0 - B_{01}\left(\sin \frac{n\pi}{1} X_1\right) + B_{02}\left(1 + \cos \frac{2\pi}{h} X_1\right),$$

where $B_x$ is the variation in the magnetic field density along the anode block axis;

$B_O$ is a constant component of the homogeneous magnetic field density along the anode block axis;

$B_{O1}$ is the amplitude of variation in the magnetic field density along the anode block axis, over its length $X_1$, which does not exceed 50% of $B_O$;

$B_{O2}$ is the amplitude of fluctuation of the magnetic field density from one pair of retardation system straps to another along the anode block axis, over its length $X_1$, which does not exceed 20% of $B_O$;

h is the spacing between strap pairs;

n=1,2,3 . . . is a coefficient equal to the number of half-cycles of the cosinusoidal distribution of the amplitude of the high-frequency electric field of a respective mode.

3 Claims, 4 Drawing Figures

MICROWAVE MAGNETRON-TYPE DEVICE

FIELD OF THE INVENTION

The present invention relates to microwave electrovacuum tubes, and more particularly to a microwave magnetron-type device.

The invention can most advantageously be used in high-power industrial microwave electronics, particularly in linear electron accelerators and thermonuclear installations for plasma heating in controlled thermonuclear fusion, which is of particular importance in obtaining new kinds of power fuel. In addition, the invention is applicable to high-power microwave ovens used in advanced industrial and agricultural processes and characterized by contamination-free operation, which is especially important in view of the currently topical ecological problem of protecting the environment.

BACKGROUND OF THE INVENTION

At present, developments in high-power industrial microwave electrovacuum devices are aimed at maximizing the power output of individual devices by increasing their energy conversion efficiency. As is known, the power output of microwave devices and, more specifically, magnetron-type microwave devices, is restricted by the physical properties of the cathode, anode and dielectric energy exit window materials, and their capacity to withstand and dissipate electrical and thermal loads. These limitations are partially overcome by the following measures: the use of special materials with improved emission characteristics for cathodes, materials with high electric and heat conductivity for anodes and cathodes, materials with maximum permissible stability to thermal overloads and low dielectric loss for energy exit windows, etc. Besides, in order to enhance the power output in a single device, the heat-dissipating surface of the anode is enlarged by, for example, increasing the axial length of the cylindrical anode block, as well as by increasing the anode surface diameter.

Enlarging the surface of the anode block of microwave magnetron-type devices always involves an increase in the number of cells of the periodic structure of the retardation system. Therewith, the electrodynamic properties of a retardation system with an enlarged and adequately developed working surface of the anode and, in particular, the separation of frequency among competing modes are impaired, which imposes certain limitations on the possibility to minimize in this way the thermal and electrical loads on the anode and cathode, hence, on the possibility to further increase the microwave generating power in a single device.

Thus, all of the above measures fail to solve the problem of enhancing the energy conversion efficiency of microwave devices, i.e. minimizing undesirable losses, especially in continuously operating devices, and more particularly those intended for industrial use. This can be easily seen from the following formula for the maximum continuous-wave (or mean) power output of microwave magnetron-type devices:

$$P = qS\left(\frac{\eta_e}{1-\eta_e}\right) \tag{1}$$

where

P is the maximum continuous-wave (or mean) microwave generation power output;

q is the maximum permissible specific load on the anode;

S is the working anode surface; and $\eta_e$ is the electronic efficiency.

The only feasible way to further increase the microwave generating power upon attaining the maximum possible values of q and S in microwave magnetron-type devices is by increasing the energy conversion efficiency, i.e. $\eta_e$.

In a microwave magnetron-type device, the electronic efficiency $\eta_e$ depends to a great extent on the density of the applied magnetic field B which is at a right angle to the static electric field E applied between the anode and cathode of the device, i.e.

$$\frac{\eta_e}{1-\eta_e}\,2\left(\frac{B}{B_0}-1\right), \tag{2}$$

where

B is the density of the applied working magnetic field;

$B_0$ is the minimum magnetic field density at which microwave generation is still possible in a microwave magnetron-type device.

However, the energy conversion efficiency in a microwave magnetron-type device depends not only on the density of the magnetic field B crossing the electric field E but also on the homogeneity and uniformity of the magnetic field B over the entire interaction space between the anode and cathode of the device. If these conditions are met and if the distribution of the magnetic field B corresponds to that of the total (static and high-frequency) electric field E in the interaction space, the energy conversion efficiency $\eta_e$ will be maximum and approach a value close to the theroretical one described in (2). Only in this case may the power output according to Eq. (1) be increased to the maximum possible value for devices of this type.

In microwave magnetron-type devices, the magnetic field along the working interaction space is created either with the aid of permanent magnets or by means of electromagnetic devices. However, the required homogeneity and distribution of the magnetic field over the entire interaction space cannot, as a general rule, be achieved solely by means of magnetic field sources, such as permanent magnets and electromagnets that are generally characterized by large scattering fields, which reduces the efficiency not only of the device but also of the magnets themselves, i.e. the ratio of the magnet mass to the actual (working) magnetic field density (M/B) is high. Therefore, in microwave magnetron-type devices, with a view to creating a homogeneous field in the working gap of the interaction space, obtaining a particular distribution pattern of the magnetic field along the interaction space, and enhancing the magnet efficiency, various improvements are introduced into the construction of the magnetic system, realizing the above objectives and, in the final analysis, ensuring stable operation of the device and attaining maximum possible efficiency.

The magnetic system of microwave magnetron-type devices normally comprises main and supplementary magnets in the form of a yoke, magnetic shunts, pole pieces, etc. which may have different embodiments and are arranged both along the periphery of the anode block in an external closed magnetic circuit, near the main magnets, and inside the evacuated housing of the device, in direct proximity to the interaction space of the device. The supplementary magnets are often made in the form of built-in pole pieces of a magnetic material (usually magnetically soft iron). Permanent magnets are most often used in microwave magnetron-type devices with a relatively short anode block and small interaction space—not more than a quarter wavelength ($<\lambda/4$). In this case, the pole pieces in a microwave magnetron-type device with a cylindrical anode block are arranged between the permanent magnet poles, are connected thereto, and are shaped as cylindrical pieces, truncated cylinders, rings, etc. (cf. "Philips Electrical Ind. Ltd" Pat. No. 778,585 of Jan. 11, 1955; "Raytheon" Pat. No. 972,526 of Sept. 24, 1943; USSR Pat. No. 1,524,058 of June 21, 1966).

Electromagnets are used primarily in microwave magnetron-type devices with an axial length of the cylindrical anode block exceeding a quarter wavelength ($>\lambda/4$) (cf. Journal of Microwave Power, 13 (1), 1978, pp. 59–64; C. Shibata, T. Akioka, V. Sato and H. Tamai, "100 kW, 915 MHz CW Magnetron for Industrial Heating Application"). In this case, in the magnetic system use is often made of magnetic shunts and pole pieces made of a magnetic material, which correct the shape and density distribution of the magnetic field created by the electromagnet along the axis of the anode block, which is particularly necessary if a solenoid is used to create a magnetic field in the interaction space of a device with a long anode block axis (exceeding $\lambda/2$). Annular magnetic shunts and pole pieces in such devices serve not only to decrease the magnetic field scattering and to improve its homogeneity in the interaction space (in order to provide for optimal conditions of interaction between the electron flow and the high-frequency field of the retardation system in the crossed magnetic field B and electric field E, thereby ensuring maximum possible energy conversion efficiency), but also to create in the interaction space, near the end faces of the anode block, magnetic traps preventing electrons from leaving the interaction space (for areas adjacent to the end faces of the anode block). Both measures minimize the undesirable losses (in the former case, due to interaction between electrons and the high-frequency field of the retardation system of the anode block and, in the latter, due to "leakage" of electrons into the areas near the end faces of the anode block) and increase the energy conversion efficiency $\eta_e$.

In microwave magnetron-type devices with great axial lengths of the interaction space, in which long anode blocks are most frequently used and are formed by multistage retardation system structures, the amplitude of the high-frequency electric field along the axis of the anode block varies cosinusoidally. This is why, in contrast to devices with a short anode block, here the conditions for interaction between the electron flow and the high-frequency field in the interaction space more closely adjacent to the end faces of the anode block are substantially different from those for interaction in a space which is closer to the mid-portion of the anode block. As a result, the energy conversion efficiency in a microwave magnetron-type device with a long anode block is always lower than in devices of the same type with a short anode block.

Thus, in devices with a long anode block, there is a problem of enhancing the efficiency of interaction between the electron flow and the high-frequency field of the retardation system with due account taken for the high-frequency component of the electric field (E), which problem is solved by creating, in the crossed fields E and B, identical conditions for interaction over the entire length of the anode-cathode spacing. For example, such conditions are provided by changing, in a certain manner, the diameters of the anode and cathode along the anode block axis (i.e. by varying the constant electric field E along the anode block axis, between the anode and cathode), as well as by designing the solenoid and the entire magnetic system of the device so as to provide for the required configuration and density distribution of the magnetic field B along the axis of the anode block.

Known in the art is a microwave magnetron-type device comprising a long cylindrical anode block with a multicavity retardation system without straps, in which the length of the interaction space along the anode block axis, confined by the gap between the cylindrical anode opening and the cylindrical cathode, is extended to a value approximately equal to a wavelength of the generated waves (cf. Booth, "Magnetrons with Long Anode", "Electronic Microwave Devices with Crossed Fields", vol. 2, Moscow, 1961, pp. 236–248/in Russian).

The magnetic field in the interaction space along the axis of the long anode block in the prior art device is created by means of a magnetic system including a solenoid and pole pieces made of a magnetic material, the pole pieces being secured on the edges of the solenoid orifice in direct proximity to the end faces of the anode block. To provide for a more homogeneous magnetic field in the working part of the interaction space, as well as to increase the magnetic field density and to change its direction near the end faces of the anode block in order to create magnetic traps preventing electrons from being ejected into the areas near the anode block end faces, bushings of various configurations, made of a material with high permeability, are provided (cf. "Marconi" Pat. No. 523,329 of Dec. 30, 1937; Journal of Microwave Power, 10 (2), 1975 "High Power Industrial Heating Magnetron development", C. B. Bighom and M. Viant).

In this microwave device with a long anode, the axial distribution of the amplitude of the high-frequency electric field in the interaction space is markedly dependent on the length of the anode block, and in the mid portion of the anode block the amplitude may be several times greater than at the ends. This results in the fact that the conditions of interaction between the electron flow and the high-frequency field of the operating mode, in the case of a homogeneous axial magnetic field created by the magnetic system of the solenoid, are dissimilar in different parts of the interaction space of the device. As a consequence, since there is a correspondence between any arbitrarily selected part of a long interaction space and its optimal performance with respect to the anodic current and anodic voltage, the region of the current-voltage characteristic of the device, in which the electronic efficiency reaches maximum values, is not pronounced; hence, the resulting efficiency is averaged, and is lower than normal for microwave magnetron-type devices.

These are the reasons why the microwave power output in the above device cannot be substantially increased, particularly in continuous-wave generation, by further extending the length of the anode block because the operation of the device becomes less stable and, in the extreme case, the device becomes inoperable (already at an anode block length exceeding a wavelength of the generated waves).

Also known in the art is a microwave magnetron-type device comprising at least one anode block with annular metal straps electrically associated with respective vanes of cavities in each anode block, having the same polarity at $\pi$-mode, and straps of different polarities, electrically associating respective vanes of the same polarity and paired in each anode block, each pair being arranged with respect to one another along the axis of a respective anode block so as to form a single multistage retardation system, means for creating a magnetic field directed along the axis of each anode block, embracing all anode blocks, and means for increasing the magnetic field density in direct proximity to the end faces of a respective anode block, forming a gap with the end faces of each anode block (cf. U.S. Pat. No. 3,045,147; Nov. 16, 1959; Cl. 315-39.69).

The means for increasing the magnetic field density, arranged in direct proximity to the end faces of the anode block and made in the form of pole pieces or rings to additionally improve the homogeneity of the magnetic field in the working part of the interaction space and to enhance the magnetic field density in direct proximity near the end faces, forms together with the magnetic field creating means, e.g. a solenoid or electromagnet, the magnetic system of the device.

In this microwave magnetron-type device with a long anode block, the straps periodically arranged along the retardation system of the anode block are made of a nonmagnetic material. The pole pieces are made of a highly permeable material to eliminate the end-face effects, i.e. to minimize ejection of electrons into the areas adjacent to the end faces of the anode block from the interaction space, and to improve the interaction between the electron flow and the high-frequency field of the retardation system in the rest of the working part of the interaction space.

Since, in the above microwave magnetron-type device with a long anode block comprising a multistage retardation system, the distribution pattern of the amplitude of the high-frequency electric field in the interaction space along the anode block axis is not taken into account in the corresponding optimal axial distribution pattern of the magnetic field density, undesirable physical phenomena occur in the operating device, leading to a poorer efficiency and stability thereof. For example, a variation in the amplitude of the high-frequency electric field between the straps of the retardation system and a variation in the total amplitude of the high-frequency electric field over the entire length of the interaction space result in that (in the case of a homogeneous magnetic field) the power of the electron back bombardment of the cathode arranged coaxially with the anode block is dissimilar in different portions of its surface along the axis. Thus, electrical and thermal loads on the cathode surface are unevenly distributed, which leads to such undesirable consequences as a poorer efficiency of the device, premature wear of the current-overloaded portions of the cathode, hence, shorter life of the device, changes in the cathode geometry and its orientation with respect to the anode block axis, poorer stability of the device in operation, etc. After operation, localized wear spots are observed on the emitting surface of the cathode, opposite the retardation system portions with maximum high-frequency amplitude in the interaction space (under straps and under the central portion of the anode block).

Closer to the center of the interaction space, considerable Coulomb forces also occur due to the nonuniform density of the space charge, which forces cause instability in the interaction of electrons with the high-frequency electric field of the retardation system, as well as leakage of electrons towards the anode (so-called dark currents which are particularly dangerous in continuous-wave generation).

As a result, the possibilities of improving the efficiency of microwave magnetron-type devices with a long anode cannot be adequately utilized. Usually, the efficiency of such devices is relatively low, amounting to 50–60%, and in continuous-wave generation they may fail, which limits the area of their application.

SUMMARY OF THE INVENTION

It is an object of the present invention to provide a microwave magnetron-type device ensuring optimal distribution of the axial magnetic field density in the interaction space of a long anode block with a multistage retardation system, with a view to enhancing the electronic efficiency of the device.

This object is attained by providing a microwave magnetron-type device comprising at least one anode block with annular metal straps electrically associated with respective vanes of cavities in each anode block, said vanes having the same polarity at $\pi$-mode, and straps of different polarities, electrically associating respective vanes of the same polarity and forming pairs in each anode block, each pair being arranged with respect to one another along the axis of a respective anode block to form a single multistage retardation system, means for creating a magnetic field directed along the axis of each anode block, said means embracing all anode blocks, and means for increasing the magnetic field density in direct proximity to the end faces of a respective anode block, and forming a gap with the end faces of each anode block. In accordance with the invention, at least some straps are at least partially made of a magnetic material, and the mass of the magnetic material of said straps is so distributed along the axis of each anode block that the magnetic field density varies along the axis of a respective anode block as follows:

$$B_x = B_0 - B_{01}\left(\sin\frac{n\pi}{l}X_l\right) + B_{02}\left(1 + \cos\frac{2\pi}{h}X_1\right),$$

where $B_x$ is the variation in the magnetic field density along the anode block axis;

$B_0$ is a constant component of the homogeneous magnetic field density along the anode block axis;

$B_{01}$ is the amplitude of variation in the magnetic field density along the anode block axis, over its length $X_1$, which does not exceed 50% of $B_0$;

$B_{02}$ is the amplitude of fluctuation of the magnetic field from one pair of retardation system straps to another along the anode block axis, over its length $X_1$, which does not exceed 20% of $B_0$;

h is the spacing between strap pairs;

$n = 1,2,3 \ldots$ is a coefficient equal to the number of half-cycles of the cosinusoidal distribution of the amplitude to the high-frequency electric field of a respective mode.

Some of the straps should preferably be made entirely of a magnetic material.

It is also preferable that each strap be partially made of a magnetic material forming a layer along the perimeter of the strap, the cross-sectional area of the magnetic material layer of the straps diminishing, from strap to strap, from the mid portion of the anode block toward its end faces.

In the proposed microwave magnetron-type device with a long anode block comprising a multistage retardation system and a magnetic system ensuring the required distribution of the magnetic field density in the interaction space, the intensity of the electron back bombardment of the cathode is less irregular and the dark current in the end-face areas of the anode block and in its mid portion is minimized. At the same time, the electronic efficiency of the device can be increased up to 90%, which permits raising the power output level in microwave magnetron-type devices, particularly in continuous-wave generation.

The rationally selected configuration of the magnetic system and the specific arrangement, over the anode block length, of the annular straps made of a magnetic material permit attainment of the required distribution of the axial magnetic field density in the interaction space with due account being taken of the distribution of the amplitude of the high-frequency electric field of the retardation system. Such a magnetic system in the microwave magnetron-type device, comprising a means for creating a magnetic field, means for increasing the magnetic field density in direct proximity to the end faces of the anode block, and annular straps of a magnetic material arranged in a certain pattern along the anode block axis, permits optimization of the conditions of interaction between the electron flow and the high-frequency field of the retardation system, as well as improvement of the characteristics and realization of the advantages of microwave magnetron-type devices with a long anode block.

BRIEF DESCRIPTION OF THE DRAWINGS

The invention will now be described in greater detail with reference to specific embodiments thereof, taken in conjunction with the accompanying drawings, in which.

DETAILED DESCRIPTION OF THE INVENTION

Figure 1:
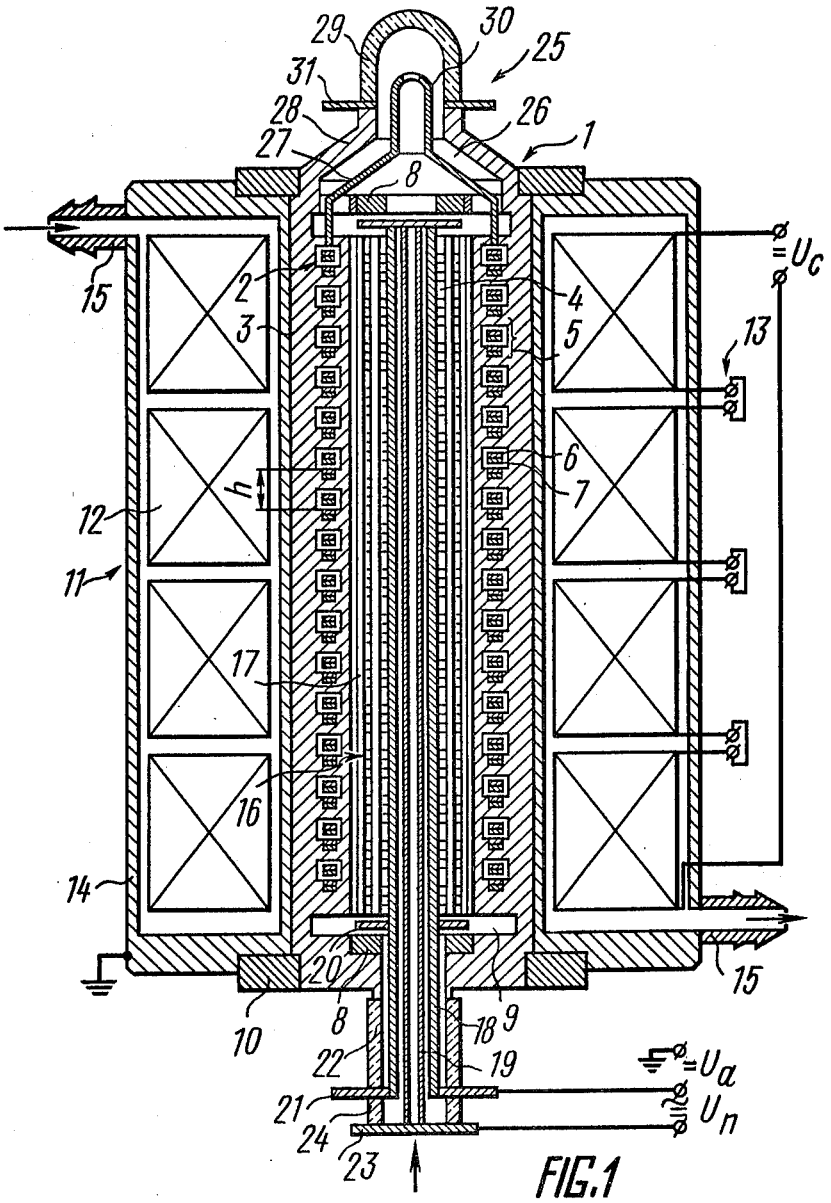
FIG. 1 is a longitudinal section view of a microwave magnetron-type device with a long cylindrical anode block made as a multistage two-dimensional periodic retardation system with annular bimetallic straps, and a circuit for connection to d-c and a-c sources, according to the invention.

In what follows, an example of the proposed microwave magnetron-type device is presented in the form of a magnetron oscillator referred to, for brevity, as a magnetron. The magnetron comprises at least one long anode block 1 (FIG. 1), in this embodiment having a cylindrical shape. Annular metal straps 2 in the anode block 1 are electrically coupled to respective vanes 3 of cavities 4, the vanes 3 having the same polarity at $\pi$-mode. Straps 2 of different polarities, interconnecting respective vanes 3 of the same polarity, form pairs 5 arranged relative to one another at a distance h along the axis of the anode block 1, over its length, making up a multistage retardation system featuring, in this embodiment, a two-dimensional periodic structure (azimuthal and axial). Since the distribution of the amplitude of the high-frequency electric field in the interaction space at a finite length of the anode block with the multistage redardation system is uneven, measures should be taken to account for and compensate for the effect of the uneven distribution of the high-frequency electric field on the operation of the device. It is known that the amplitude of the high-frequency electric field in the interaction space varies consinusoidally both between stages of the retardation system and along the anode block axis.

If the magnetic field created by the magnetic system of the herein disclosed device is made non-homogeneous and varying over the length of the anode block 1 and from stage to stage of the retardation system, the following applies:

$$B_x = B_0 - B_{01}\left(\sin\frac{n\pi}{l}X_1\right) + B_{02}\left(1 + \cos\frac{2\pi}{h}X_1\right), \quad (3)$$

where $B_x$ is the variation in the magnetic field density along the axis of the anode block 1;

$B_0$ is a constant component of the homogeneous magnetic field density along the axis of the anode block 1;

$B_{01}$ is the amplitude of variation in the magnetic field density along the axis of the anode block 1, over its length $X_1$, which does not exceed 50% of $B_0$;

$B_{02}$ is the amplitude of fluctuation of the magnetic field density from one pair 5 of straps 2 of the retardation system to another along the axis of the anode block 1, over its length $X_1$, which does not exceed 20% of $B_0$;

h is the spacing between pairs 5 of straps 2;

n=1,2,3 . . . is a coefficient equal to the number of half-cycles of the cosinusoidal distribution of the amplitude of the high-frequency field of a respective mode.

Then, approximately in accordance with the variation pattern of the amplitude of the high-frequency electric field on respective stages of the retardation system, the device will operate more stably and with a higher efficiency.

In prior art microwave magnetron-type devices, this variation pattern of the magnetic field along the anode block can be achieved by selecting the operating conditions of the solenoid. To this end, the solenoid is made of several coil sections arranged along its axis, which are energized from individual power supplies (rectifiers). Individual selection of the current through each section provides for an axial distribution of the magnetic field density in the interaction space of the device such that the latter operates more stably and with a maximum efficiency in normal operation. This, however, involves complicated design of the solenoid itself and the power supplies, while individual selection of the solenoid operating conditions (current) is not effective and is poorly reproducible.

Moreover, the selection of the current through the solenoid sections, the height (along the solenoid axis) of which exceeds the spacing between stages of the retardation system, as well as the use of only two pole pieces at a great length of the anode block, fail to provide the necessary variation pattern of the configuration and structure of the magnetic field over the length of the interaction space. Thus, leakage currents and irregular intensity of electron back bombardment of the cathode cannot be fully eliminated in this manner.

There is another possible way to provide for the required variation pattern of the magnetic field density along the anode block axis with the aid of magnetic system means. Special bushings or rings made of a magnetic material can be incorporated into the anode block and arranged over its entire length so that their mass varies in accordance with Eq. (3) expressing the required distribution of the magnetic field density along the anode block axis. Therewith, since these rings or bushings of a magnetic material must be as close to the interaction space as possible, i.e. have the least possible diameter, said means should preferably be the straps themselves of the multistage retardation system of the anode block, the structural arrangement of which is shown in FIG. 1.

Figure 2:
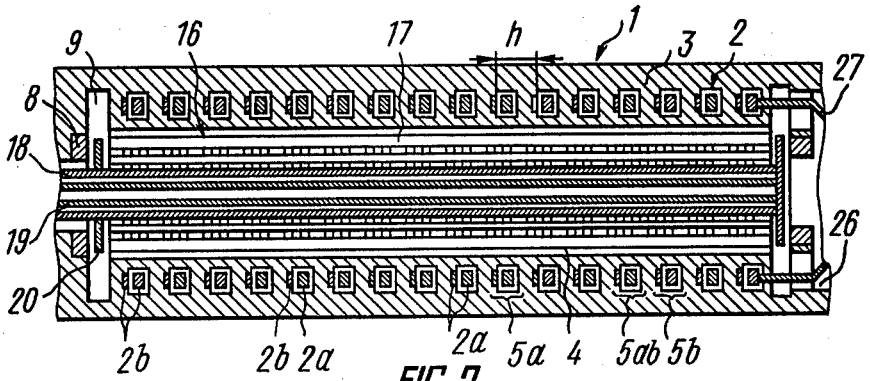
FIG. 2 is a longitudinal section view of a part of the anode block of the proposed device with a cathode and annular straps, some of which are made entirely of a magnetic material, according to the invention.

Each strap 2 of the anode block 1 contains a layer of a magnetic material, extending over its perimeter, the cross-sectional area of that layer diminishing, from one strap 2 to another, from the mid portion of the anode block 1 toward its end faces. In this embodiment, the straps 2 are made bimetallic, each comprising two metal rings joined at their end surfaces, that is, rings 6 of a magnetic material and rings 7 of a nonmagnetic material. For example, some straps 2*a* (FIG. 2) are made entirely of a magnetic material (hatched in one direction), while other straps 2*b* are made of a nonmagnetic material (hatched in the opposite direction). In this case, the straps 2*a* forming pairs 5*a* in the mid-portion of the anode block 1, where the amplitude of the high-frequency electric field is maximum, are all made of a magnetic material (about 30% of all pairs 5). Other pairs 5*ab* of straps 2*a*, 2*b* located farther from the mid-portion of the anode block 1 (also about 30% of all pairs 5), which accommodates the pairs 5*a*, are made of a magnetic material only alternately, i.e. the pairs 5*ab* include straps 2*a* and 2*b*, and, finally, the remaining pairs 5*ab* (about 20% of all pairs 5) are located closer to the end faces of the anode block 1 and alternate with pairs 5*b* made of a nonmagnetic material.

Other combinations and sequences of straps made of a magnetic material are possible, including the case where all straps are made of a magnetic material but have different masses (hollow, variably thick, etc.).

In addition to the straps 2 of a magnetic material, the magnetic system also includes means for increasing the magnetic field density in direct proximity to the end faces of the anode block 1. In this embodiment, such means include two end bushings 8 made of a magnetic material and arranged in end-face areas 9 of the anode block 1, as well as pole pieces 10 (FIG. 1). The system also includes means for creating a magnetic field, in this embodiment constituted by a solenoid 11 composed of several coil sections 12 connected in series through terminals 13, the solenoid 11 being energized from a single voltage source $U_c$. In some cases, the coils of the solenoid 11 are connected to separate power supplies, for example, when it is necessary to adjust the distribution of the magnetic field in the interaction space of the device. The solenoid 11 can also be energized through a connection of an anode circuit for supplying power to the magnetron from an anodic voltage source $U_a$. The solenoid 11 and the anode block 1 are in adequate thermal contact and share a common airtight jacket 14 for cooling the anode block 1 and the coils of the solenoid 11.

A liquid coolant is let in and out of the jacket 14 through unions 15. Arranged coaxially with an opening 16 formed by the ends 17 of the vanes 3 are a cathode 18 and a heater 19 which are essentially two coaxial metal tubes. The cathode 18 is provided on both ends with shields 20 preventing electrons from being ejected into the end-face areas 9 from the interaction space, and is electrically associated with an output terminal 21 through an evacuated high-voltage cermet insulator 22, with the aid of which it is secured to the anode block 1. The heater 19 is electrically coupled to an output terminal 23 through an evacuated cermet insulator 24, by means of which it is attached to the terminal 21 of the cathode 18.

The terminals 21 and 23 of the cathode 18 and heater 19 are connected to the terminals of the sources $U_a$ and $U_f$ of the anodic voltage and filament current, respectively. The anode block 1 and the solenoid 11 which are at a positive potential are grounded.

A power output section 25 has an end-face symmetrical output coupler including a tapering coaxial line 26 having an internal tapering conductor 27 which is electrically associated with the extreme strap 2 of the extreme pair 5, whereas an external tapering conductor 28 is associated with the anode block 1 in its end-face portion. The power output section 25 with a radiating antenna 30 is sealed by a ceramic exit window 29 secured through a collar 31 to the external tapering conductor 28 of the end-face symmetrical output coupler.

Figure 3:
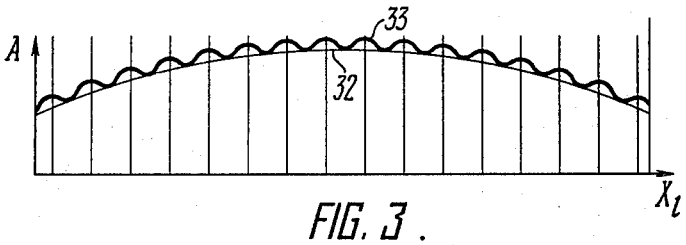
FIG. 3 shows the distribution of the amplitude A of the high-frequency electric field over the length $X_1$ of the interaction space of the proposed device, according to the invention.
Figure 4:
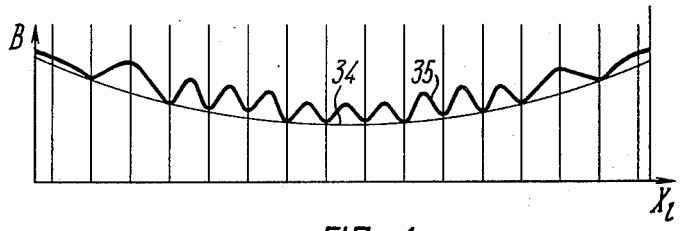
FIG. 4 shows the distribution of the magnetic field density B over the length $X_1$ of the interaction space of the proposed device, according to the invention.

For a better understanding of the present invention, FIGS. 3 and 4 represent graphs showing the distribution of the amplitude A of the high-frequency electric field (FIG. 3) and the magnetic field density B (FIG. 4) in the interaction space of the anode block 1 with a multistage retardation system versus the length $X_1$, in accordance with Eq. (3), the magnetic system of the device being made as described above (for optimizing the operation of the magnetron with a long anode block in the crossed fields E and B). Curve 32 in FIG. 3 represents the variation in the amplitude of the high-frequency electric field in the interaction space of the anode block 1, over its length, while curve 33 illustrates the amplitude variation in the interaction space between retardation system stages. Accordingly, curves 34 and 35 (FIG. 4) represent the variations in the magnetic field density in the interaction space along the anode block 1 and between retardation system stages.

The proposed microwave magnetron-type device operates as follows.

The cathode 18 (FIGS. 1 and 2) which is in the center of the anode opening 16 of the evacuated anode block 1 is heated to a required temperature with the aid of the electric heater 19 energized from the a-c or d-c filament current source $U_f$ (FIG. 1).

The electrons emitted by the cathode 18 into the interaction space are accelerated toward the anode by the electric field created by the constant anodic voltage source $U_a$ between the cathode 18 and anode. The anodic voltage from the source $U_a$ is applied via a grounded-anode circuit. In the presence of the magnetic field B created by the solenoid 11 made up of the pole pieces 10, end-face bushings 8 and straps 2 and directed, as indicated by the arrow in the drawing, along the axis of the anode block 1, at a certain magnitude of the anodic voltage $U_a$, the electrons excite high-frequency oscillations in the retardation system of the device through gaps between the ends 17 of the vanes 3. The high-frequency field initiated in these gaps groups electrons into beams which move, under the action of the applied anodic voltage $U_a$ and magnetic field B, in an azimuth-like manner along the anode surface synchronously with the excited retarded wave of high-frequency oscillations in its retarding phase, and transmit the supplied power to the microwave electromagnetic field. Thus, the power from the anodic voltage source $U_a$ is transformed to microwave energy. The latter is accumulated in the cavities 4 of the retardation system, which at this moment is in a resonance state. The retardation system resonates in a mode in accordance with a frequency which meets the condition of synchronism at a given anodic voltage and a given magnetic field.

The magnetron as disclosed herein operates as an oscillator (in self-excitation) normally at the longest-wave $\pi$-mode. The magnetron may also operate as an amplifier driven by an external control signal synchronizing the high-frequency oscillations in the retardation system.

An advantage of the proposed device with a long anode block is that the magnetic system, comprising external components (the solenoid 11 and pole pieces 10) and internal components (end-face bushings 8 and straps 2), creates a magnetic field in the interaction space with due account being taken of axial distribution of the amplitude of the high-frequency electric field, both from stage to stage and over the entire length of the multistage retardation system.

The annular bimetallic straps 2 containing rings 6 of a magnetic material slightly deform the homogeneous magnetic field created by the solenoid 11 and the rest of the magnetic system. As a result of the above-described arrangement of the straps 2 made of a magnetic material, corresponding to optimal interaction between the electron flow and high-frequency field of the retardation system and distribution of the magnetic field density in the interaction space, a system of magnetic lenses is formed. This system varies the magnetic field along the anode block axis according to $$B_{01}\left(\sin\frac{n\pi}{1}X_1\right)$$

and from stage to stage according to $$B_{02}\left(1+\cos\frac{2\pi}{h}X_1\right).$$

Therewith, in accordance with the distribution of the high-frequency electric field amplitude (shown in FIG. 3) along the interaction space, wherever this amplitude increases, the magnetic field B (FIG. 4) decreases. This permits a substantial decrease in the effect of uneven distribution of the amplitude of the high-frequency electric field of the multistage retardation system of a magnetron with a long anode block, thereby equalizing the intensity of electron back bombardment of the cathode along its length and minimizing dark currents. This, in turn, enhances the efficiency of the device as a whole, and improves its stability in operation and durability.

The end-face bushings 8 of the magnetic system and the pole pieces 10 reduce the scattering fields of the solenoid 11, whereby its efficiency is enhanced, the homogeneity of the magnetic field in the interaction space of the device is improved, and the magnetic field in the anode block end-face areas is somewhat increased (due to magnetic traps). The latter also minimizes the ejection of electrons into the end-face areas 9 (end-face currents) and increases the efficiency of the device.

The magnetic field in the solenoid is induced by the current through the windings of the coils of the sections 12, connected in series through the terminals 13 and energized from a single or several constant voltage sources $U_c$.

Another advantage of the proposed magnetron resides in the fact that the magnetic system contains, over the entire length of the interaction space, means for retaining, in a relatively stable manner, the required axial distribution pattern of the magnetic field density (with the aid of annular straps 2 made of a magnetic material). This practically excludes the need to individually select the operating conditions for the solenoid 11 (by selecting the appropriate current through each of its sections), thereby ensuring stable operation of the magnetron and increasing its efficiency (as is the case when such means are absent in the device). In the presence of such means for creating a magnetic field in the interaction space of the anode block, there is also a radial magnetic field density component which is relatively small over the entire length of the interaction space and retains electrons on azimuth-like orbits. That is, the component compensates for the Coulomb forces ejecting electrons from the center of the interaction space into the end-face areas. Besides, the required distribution of the magnetic field density and the radial components of the magnetic field, ensured by these means, provide conditions which prevent a secondary electron discharge between the end surfaces of heteropolar pairs 5 of straps 2, which discharge is especially dangerous in continuous-wave generation. The solenoid 11 in the embodiment under consideration and the anode block 1 have their mating surfaces in good thermal contact, namely, via the inner cylindrical surface of the solenoid 11 and the outer cylindrical surface of the anode block 1, and are cooled by a liquid coolant circulating inside the cooling jacket 14 which encloses the coil sections 12 of the solenoid 11. The liquid coolant is let in and out through the unions 15. The generated high-frequency power is taken out, via the tapering coaxial line 26, the internal tapering conductor 27 of which is electrically coupled to the extreme strap 2 of the extreme pair 5 and the external tapering conductor 28 of which is coupled to the anode block 1, the power being taken from the retardation system of the anode block 1 by means of the antenna 30 into a working load (not shown) through the ceramic window 29 of the power output section 25.

The structural features and improvements in a microwave magnetron-type device with a long anode block and a multistage retardation system provide for a new distributed magnetic system owing to the fact that at least some of the retardation system straps are made of a magnetic material, the mass of which is distributed over the entire length of the anode block in a pattern which varies inversely with that of distribution of the magnetic field density in the interaction space of the device and which is optimal for its operation, with due account being taken of the distribution of the high-frequency electric field amplitude in the interaction space.

Thus, in the proposed microwave magnetron-type device, the electronic efficiency is enhanced by improving the interaction between the electron flow and the high-frequency field of the multistage retardation system, minimizing the leakage currents, dark currents, cathodic and anodic losses, and losses due to the secondary electron discharge, and this provides, owing to the use of a new distributed magnetic system, for a higher power output and efficiency of the device and a broader area of its application, particularly in continuous-wave generation.

What is claimed is:

1. A microwave magnetron-type device, comprising:

at least one anode block, each said at least one anode block having cavities formed therein;

said device further comprising vanes for electrically connecting said cavities;

each said at least one anode block further comprising annular metal straps electrically associated with respective said vanes in each said at least one anode block, and having the same polarity at $\pi$-mode;

said annular metal straps otherwise having different polarities, and electrically associating those of said vanes having the same polarity and forming pairs of said annular metal straps in each said at least one anode block;

each said at least one anode block having an axis, said pairs of said annular metal straps being arranged with respect to one another along the axis of respective said at least one anode block to form a single multi-stage retardation system;

said device further comprising means for creating a magnetic field having a magnetic field density and directed along the axis of each said at least one anode block, and embracing all of said at least one anode blocks;

each said at least one anode block having end faces, said device further comprising means for increasing the magnetic field density in direct proximity to the end faces of each said at least one anode block, and forming a gap with said end faces of said end faces of respective said at least one anode block;

at least some of said annular metal straps being at least partially made of a magnetic material having a mass, the mass of said magnetic material of said annular metal straps being so distributed along the axis of each said at least one anode block that the magnetic field density varies along the axis of respective said at least one anode block as follows:

$$B_x = B_0 - B_{01}\left(\sin\frac{n\pi}{l}X_1\right) + B_{02}\left(1 + \cos\frac{2\pi}{h}X_1\right),$$

where $B_x$ is a variation in the magnetic field density along the axis of said at least one anode block;

$B_0$ is a constant component of the homogeneous magnetic field density along the axis of said at least one anode block;

$B_{01}$ is the amplitude of variation in the magnetic field density along the axis of said at least one anode block, over its length $X_1$, which does not exceed 50% of $B_0$;

$B_{02}$ is the amplitude of fluctuation of the magnetic field density from one said pair of said annular metal straps of said single multi-stage retardation system to another along the axis of said at least one anode block, over its length $X_1$, which does not exceed 20% of $B_0$;

h is the spacing between said pairs of said annular metal straps;

$n = 1,2,3 \ldots$ is a coefficient equal to the number of half-cycles of a cosinusoidal distribution of an amplitude of a high-frequency electric field of a respective mode;

said vanes having ends, each said at least one anode block having an anode opening formed therein, and defined by the ends of said vanes;

said device further comprising a cathode arranged in said anode opening of respective said at least one anode block;

each said cathode having a heater of said cathode, each said heater being arranged, together with corresponding said cathode in direct proximity thereto, in corresponding said anode opening;

said device further including means comprising evacuated cermet insulators for holding said cathode and heater in said anode opening;

said device further comprising a filament current source for said heater, and electrically associated therewith;

said device further comprising an anodic voltage source electrically associated with said at least one anode block and said cathode thereof;

said means for creating a magnetic field including a source of voltage;

said device further comprising at least one power output section including an output coupler electrically associated with said at least one anode block.

2. A microwave device as claimed in claim 1, wherein some of said annular metal straps are made entirely of said magnetic material.

3. A microwave device as claimed in claim 1, wherein said annular metal straps each have a perimeter and are partially made of said magnetic material; said magnetic material in each said annular metal strap forming a layer along the perimeter of said annular metal strap, each said layer having a cross-sectional area which diminishes from strap to strap from a mid-portion of said at least one anode block toward said end faces thereof.

* * * * *